US005685704A

United States Patent [19]

Cornet

[11] Patent Number: 5,685,704

[45] Date of Patent: Nov. 11, 1997

[54] ROTARY GEAR PUMP HAVING ASYMMETRICAL CONVEX TOOTH PROFILES

[75] Inventor: Albert René Maurice Joseph Cornet, Verviers, Belgium

[73] Assignee: Societe Techspace Aero, Milmort Herstal Belgique, Belgium

[21] Appl. No.: 625,219

[22] Filed: Apr. 1, 1996

[30] Foreign Application Priority Data

Apr. 4, 1995 [EP] European Pat. Off. ..... 95200845

[51] Int. Cl.[6] ..... F04C 2/10

[52] U.S. Cl. ..... 418/168

[58] Field of Search ..... 418/168, 169

[56] References Cited

U.S. PATENT DOCUMENTS

| | | | |
|---|---|---|---|
| 1,753,476 | 4/1930 | Richer | 418/168 |
| 2,053,919 | 9/1936 | Pigott | 418/168 |
| 2,458,958 | 1/1949 | Pigott et al. | 418/168 |
| 2,760,438 | 8/1956 | Hill | 418/168 |
| 2,822,760 | 2/1958 | Schirmer et al. | 418/168 |
| 3,361,074 | 1/1968 | Eckerle | 418/168 |
| 3,758,244 | 9/1973 | Gerber | 418/169 |

FOREIGN PATENT DOCUMENTS

| | | |
|---|---|---|
| 0 301 158 | 2/1989 | European Pat. Off. . |
| 1504705 | 10/1967 | France . |
| 41 33 880 | 4/1993 | Germany . |
| 2-27179 | 1/1990 | Japan . |

*Primary Examiner*—John J. Vrablik

*Attorney, Agent, or Firm*—Bacon & Thomas

[57] ABSTRACT

A rotary displacement pump having a rotatable gear rotor is disclosed, the gear rotor having an outer ring gear with a plurality of internal teeth engaging the external teeth on a pinion gear which is, in turn, attached to a rotatable shaft. The ring gear has an outer diameter that is approximately equal to the diameter of the root circle of the internal gear teeth such that the plurality of teeth are circumferentially spaced apart to form generally radial passageways. The ring gear has one or more annular portions connecting the plurality of internal gear teeth. Each of the internal gear teeth has a forward portion and a rear portion, measured in the direction of rotation of the ring gear, with a tooth profile having a convex forward portion with a radius R1 and a convex rear portion having a radius R2 such that R1>R2. The annular portion of the ring gear may have an outer diameter greater than that of the portion of the ring gear forming the internal gear teeth and a single such annular portion may be utilized to connect the plurality of internal teeth such that all the teeth extend from the single annular portion in cantilever fashion.

3 Claims, 4 Drawing Sheets

FIG. 9
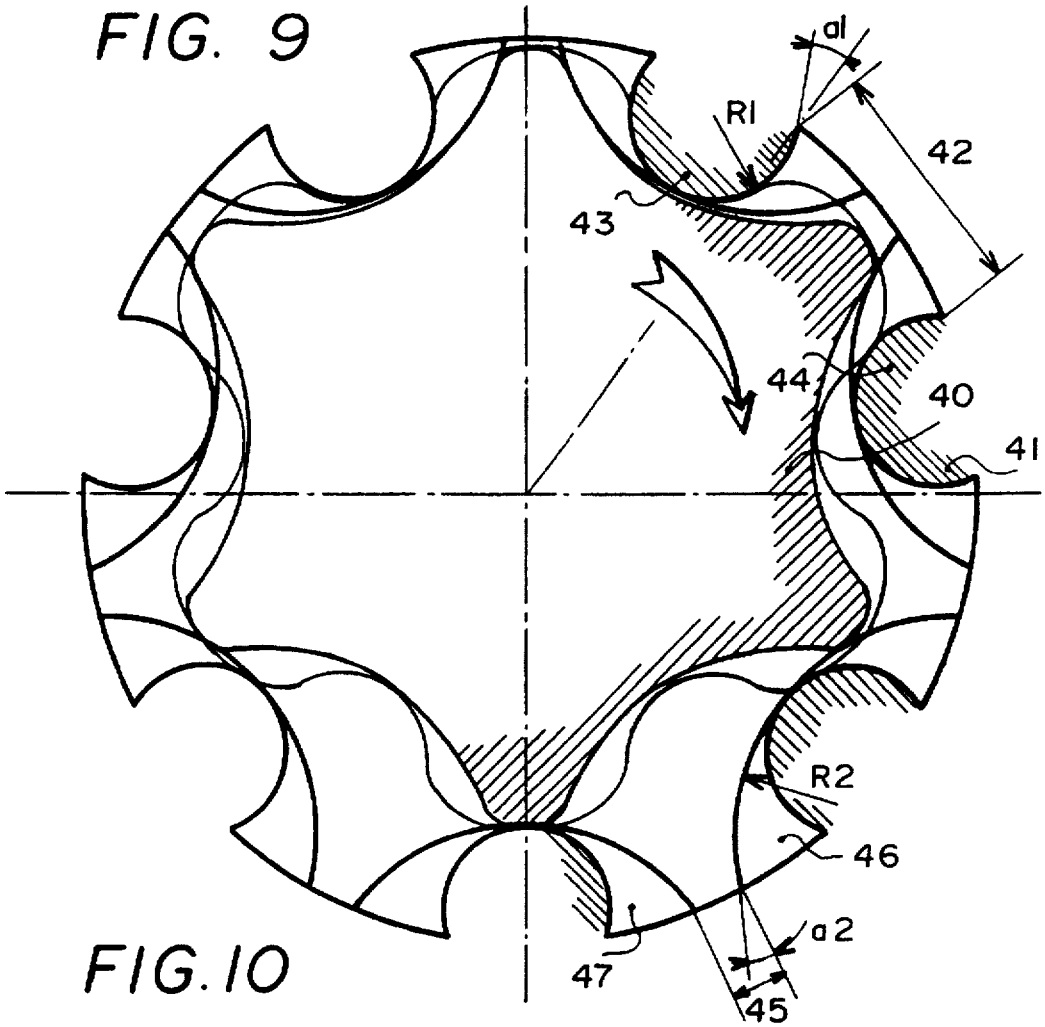
FIG. 10
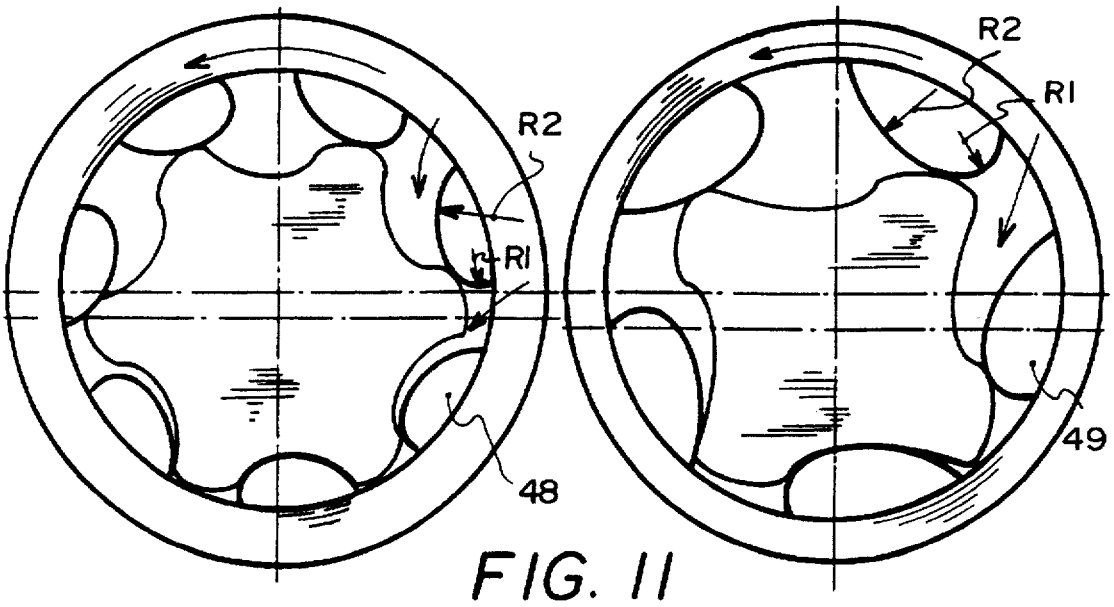
FIG. 11

ROTARY GEAR PUMP HAVING ASYMMETRICAL CONVEX TOOTH PROFILES

BACKGROUND OF THE INVENTION

The present invention relates to a rotary gear pump, more particularly such a rotary gear pump having a gear rotor or a rotor of the trochoidal type with radial fluid inlets and outlets.

A known type of gear rotor pump is illustrated in FIGS. 1 and 2, this type of pump having an axial inlet and outlet wherein the fluid flows into the gear rotor in directions substantially parallel to the axis of rotation of the rotor and flows out of the rotor in directions substantially parallel to its axis of rotation. As can be seen in the figures, the fluid is drawn into cavities 1 having a cyclically changing volume wherein the cavities are created between external teeth 2 of the pinion 4 and the internal teeth 3 of the ring gear 5, which together form the gear rotor. As best seen in FIG. 2, the fluid is drawn into and expelled from the cavities 1 through opposite, axially spaced side planes of the gear set which extend generally perpendicular to the axis of rotation A of the gear rotor. Recesses 6 are formed in the end blocks 7 of the pump so as to facilitate the fluid flow into and out of the rotor. Pump suction and fluid displacement takes place in an axial direction parallel to the axis of rotation A of the gear rotor.

This design entails a number of drawbacks. First, the effective cross-section encountered by the fluid passing into the gear rotor comprises only the cross-sectional area of the cavities regardless of the axial length of the gear rotor. Therefore, pump output cannot be increased by increasing the axial length of the rotor and operating the pump beyond a limit at which the cross-sections of the cavities are insufficient to allow the cavities to be filled, will result in premature cavitation.

Moreover, the recesses 6 formed in the end blocks of the pump must have an axial length proportional to the axial length of the gear rotor, thereby increasing the overall size of the pump in the axial direction. Lastly, the motion of the fluid into an out of the pump must undergo directional changes with consequent losses of energy and pressure.

FIGS. 3 and 4 illustrate another known design utilizing radial and axial fluid intakes and outlets. Radial channels 10 are formed in the ring gear 15 extending in a generally radial direction to facilitate communication between the inlet chamber 16 and the cavities 11, as well as between the cavities 11 and a corresponding discharge or outlet chamber. While this design allows increasing the cross-sectional fluid intake area, it still suffers from drawbacks. The manufacture of the radial channels 10 is a delicate operation requiring skilled labor, thereby increasing the overall costs of the pump. The cross-sectional area of the channels 10 supplements the axial inlet and outlet which are still required and, thereby, the overall axial length of the pump remains restricted. The volumes subtended by channels 10 also constitute a significant dead volume which strongly degrades pump performance, particularly its self-priming capability and its compressible fluid volumetric output.

The centrifugal forces generated by the rotation of the gear rotor assembly acts against the fluid entering the cavities thereby restricting the effectiveness of the radial feed.

SUMMARY OF THE INVENTION

A rotary displacement pump having a rotatable gear rotor is disclosed, the gear rotor having an outer ring gear with a plurality of internal teeth engaging the external teeth on a pinion gear which is, in turn, attached to a rotatable shaft. The ring gear has an outer diameter that is approximately equal to the diameter of the root circle of the internal gear teeth such that the plurality of teeth are circumferentially spaced apart to form generally radial passageways. The ring gear has one or more annular portions connecting the plurality of internal gear teeth. Each of the internal gear teeth has a forward portion and a rear potion, measured in the direction of rotation of the ring gear, with a tooth profile having a convex forward portion with a radius R1 and a convex rear portion having a radius R2 such that R1>R2. The annular potion of the ring gear may have an outer diameter greater than that of the potion of the ring gear forming the internal gear teeth and a single such annular portion may be utilized to connect the plurality of internal teeth such that all the teeth extend from the single annular portion in cantilever fashion.

An object of the invention is to provide a rotary displacement pump with intermeshing gears of the gear rotor type that transcends the limits of the known axial feed designs without incurring the drawbacks of the known designs. This is achieved by providing the internal teeth of the ring gear with an asymmetrical profile, the radius of which varies along the tooth profile, being smaller at a rear portion of the tooth and larger at a front portion, measured in the direction of rotation of the ring gear. The external teeth of the inner pinion gear are, of course, conjugate with the tooth profile of the ring gear teeth.

BRIEF DESCRIPTION OF THE DRAWINGS

FIG. 9 is a schematic diagram illustrating the formation of the tooth profiles on the ring gear according to the present invention.

FIGS. 10 and 11 are side views of pumps according to the present invention illustrating pinion gears with six and four teeth, respectively.

DETAILED DESCRIPTION OF THE PREFERRED EMBODIMENT

Figure 1:
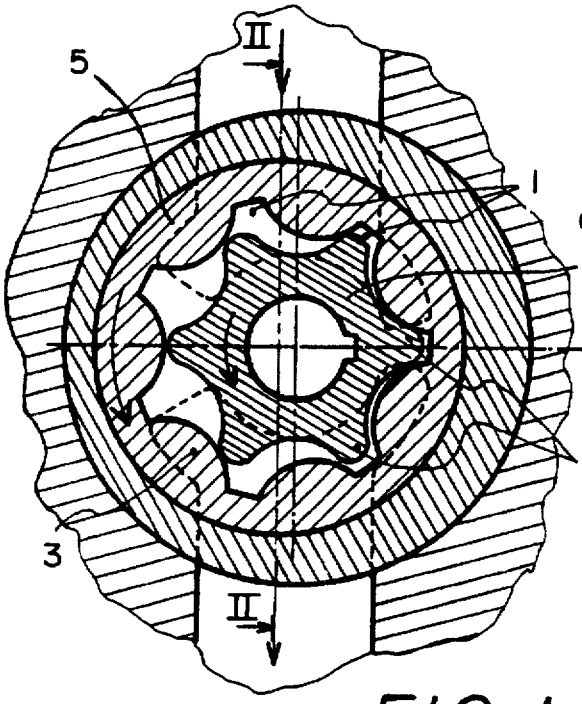
FIG. 1 (PRIOR ART)
FIG. 1 is a cross-sectional view of a known type of axial feed gear rotor pump.
Figure 2:
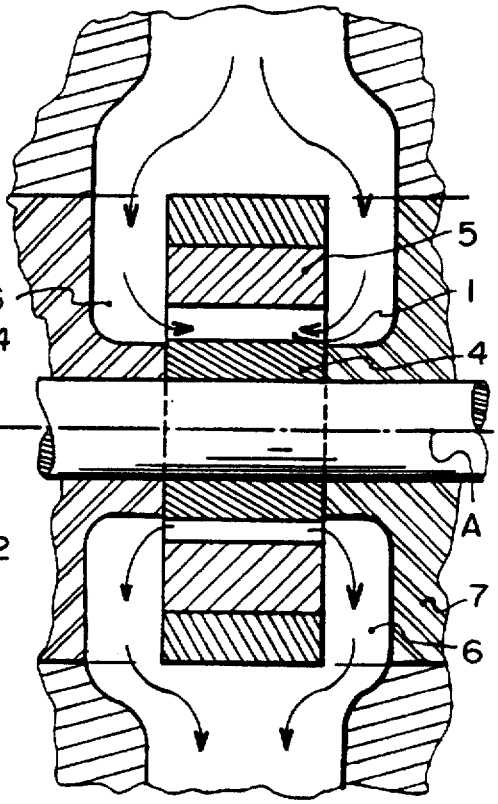
FIG. 2 (PRIOR ART)
FIG. 2 is a cross-sectional view taken along line II—II in FIG. 1.

The gear rotor displacement pump according to the present invention is illustrated in FIGS. 5–8. The pump comprises a gear set 20 composed of a pinion gear 21 and an outer ring gear 23 with internal teeth 29 cooperatively engaged with external teeth formed on the pinion 21. As is well known on the art, the number of teeth on the pinion 21 will be less than the number of internal teeth 29 on the ring gear 23 such that, as these elements are rotated, expanding and contracting cavities are formed between the internal and external teeth. The gear set 20 is rotatably mounted between casing portions 25 and 26 with this sub-assembly being further mounted between end blocks 27 and 28. The ring gear 23 has a plurality of teeth 29 separated by passageways 30 which constitute open passageways between the teeth 29 which extend along an axial portion 31 of the ring gear 23. The outside diameter D1 of the ring gear portion 31 has a value approximately equal to, or slightly exceeding, that of the theoretical minimum diameter of the root circle of the teeth of the ring gear 23. Accordingly, the internal teeth 29 are spaced apart in a circumferential direction on the portion 31 of the ring gear 23. Ring gear 23 also has at least one portion 32 formed as a continuous annulus with an outside diameter D2 such that D2 is larger than D1. As can be seen best in FIG. 6, the annular potion 33 connects one end of all of the teeth 29 such that the teeth 29 extend from the annulus in a cantilever fashion.

In a variation of this embodiment, the single annular potion 33 may be replaced by two or more such annular portions provided that the open passageways 30 between the teeth 29 are preserved. The diameter of the annular portion, as well as its location on either side of the teeth 29 may also be varied according to the requirements of a specific pump application.

Figure 8:
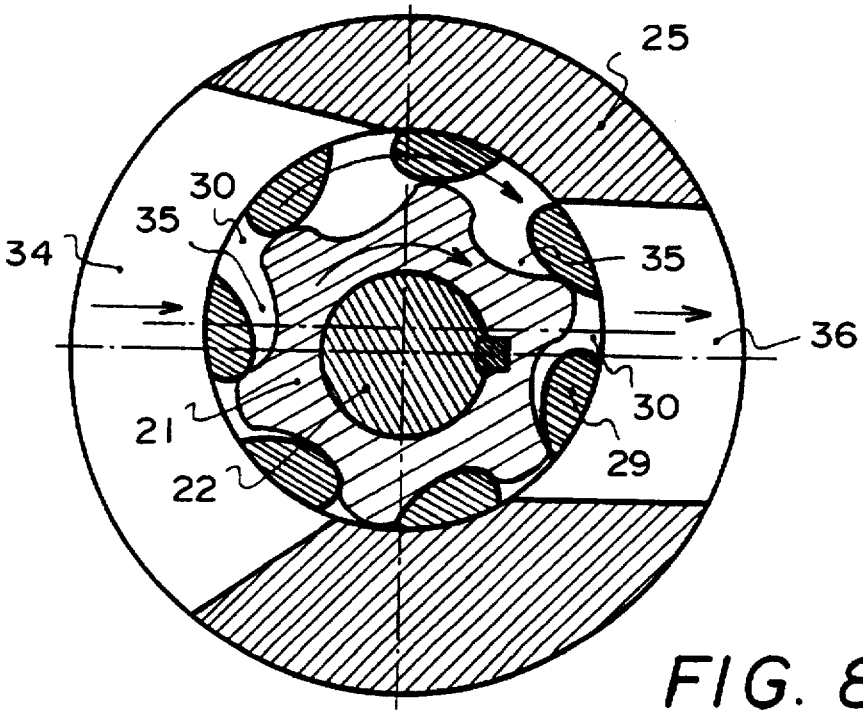
FIG. 8 is a cross-sectional view of the pump illustrated in FIG. 7 taken in a plane perpendicular to the axis of rotation of the gear rotor.
Figure 7:
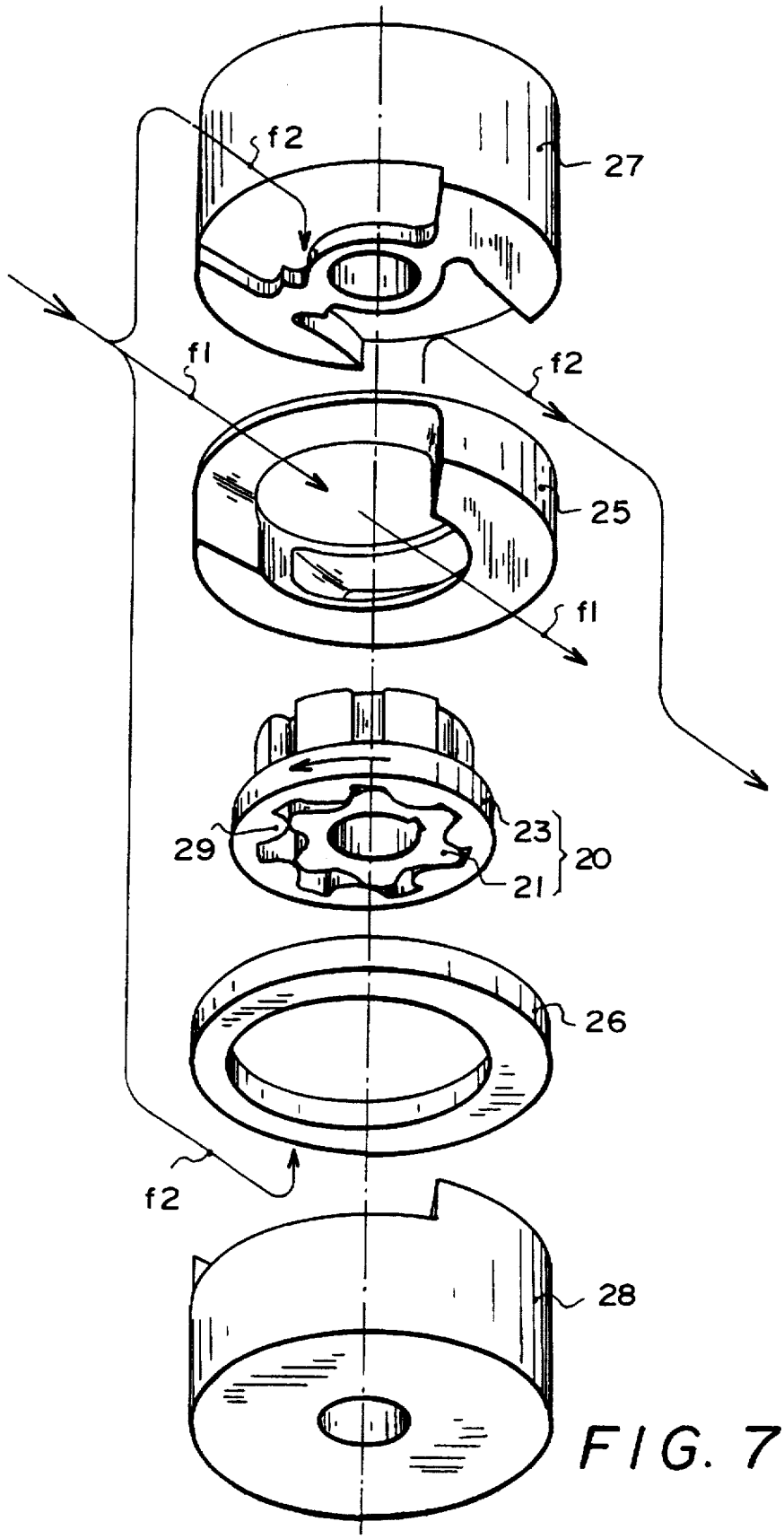
FIG. 7 is an exploded, perspective view of the rotary displacement pump according to the present invention.

In operation, as best seen in FIGS. 7 and 8, a side inlet opening 34 in the casing portion 25 allows fluid to flow into the assembly such that the fluid passes through the radial passageways 30 into the cavities 35 between the internal and external teeth. A side outlet opening 36 is also defined by the casing portion 25 and is located generally diametrically opposite to the inlet opening 34 across the rotating gear set 20. In this manner, the radial pump feed cross-section is larger than the conventional axial feed cross-section of the known gear rotor pumps without thereby incurring the production difficulties entailed by the radial channels being drilled through the external ring gear as in the known devices.

The radial feed of the invention may also be combined with a conventional axial feed passing through the axial end planes of the gear set 20 as schematically illustrated by arrows f2 in FIG. 7. The fluid flow along the path indicated by arrows f2 will complement the main radial fluid flow illustrated by arrow f1 in FIG. 7.

Figure 3:
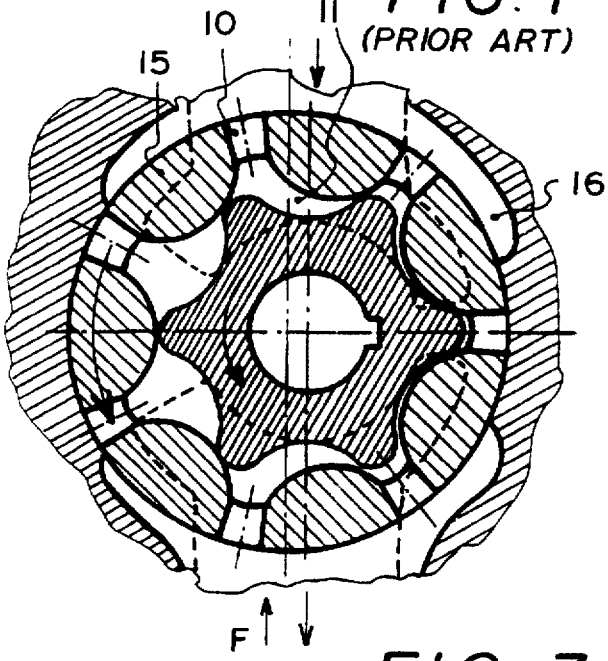
FIG. 3 (PRIOR ART)
FIG. 3 is a cross-section view of a known type of axial and radial feed gear rotor pump.
Figure 4:
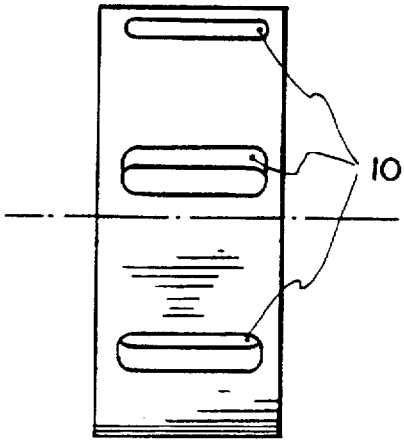
FIG. 4 (PRIOR ART)
FIG. 4 is a view of the ring gear utilized in the pump of FIG. 3 viewed in the direction of arrow F in FIG. 3.
Figure 5:
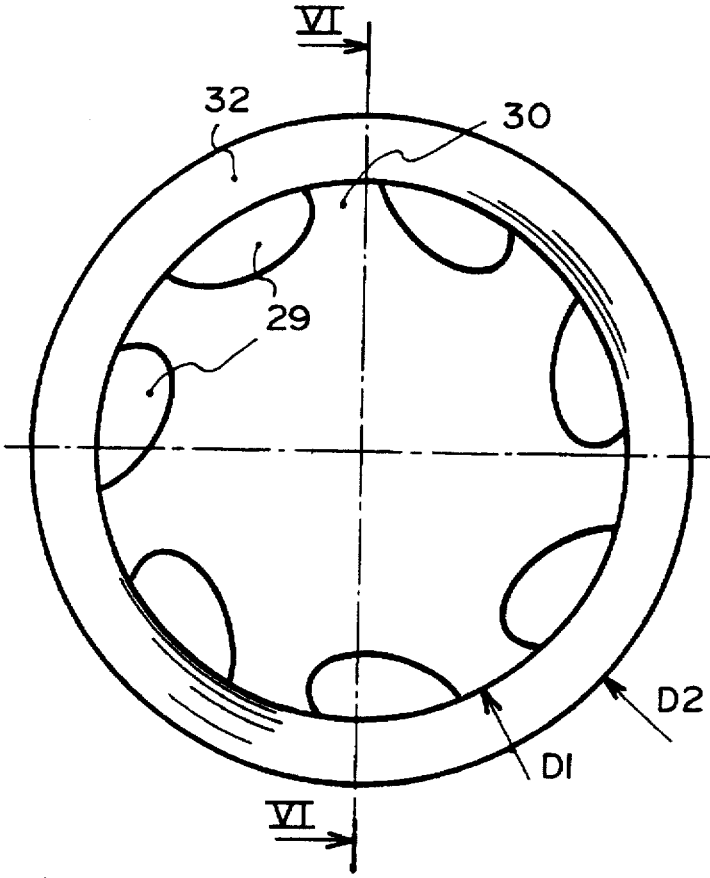
FIG. 5 is a side view of the outer ring gear utilized in the pump according to the present invention.
Figure 6:
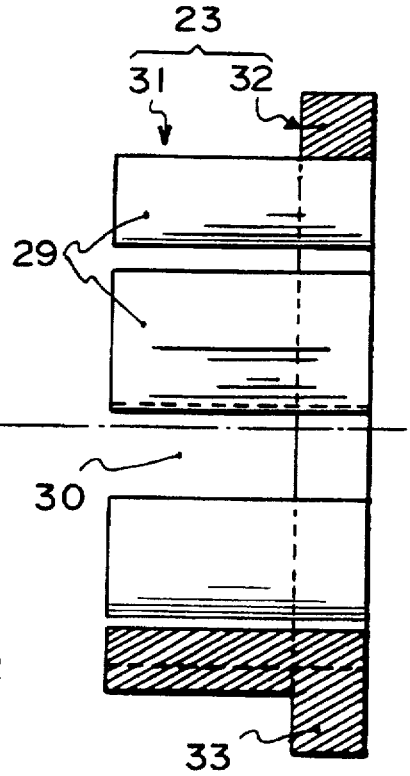
FIG. 6 is a cross-sectional view taken along line VI—VI in FIG. 5.

The design according to the present invention also minimizes the effects of centrifugal force acting on the fluid entering the pumping cavities. Instead of the profile of the internal gear teeth being generally circular arcs, as illustrated in FIGS. 1 and 3, the tooth profile of each of the internal ring gear teeth have an asymmetrical profile. FIG. 9 schematically illustrates tooth contours for a pinion 40 and a ring gear 41 with the criteria for determining the asymmetrical tooth contour of the present invention. If the internal gear teeth were formed with a constant radius R1 the free space 42 between adjacent teeth 43 and 41 would be relatively large while the corresponding dimension of the teeth would be relatively small. However, as the gear set rotates in the direction of the arrow in FIG. 9, the potion of tooth 43 coming into initial contact with the fluid entering the gear rotor has an engagement angle a1 which is negative insofar as it would urge the fluid away from entering the passageway between the gear teeth.

If the internal teeth were formed with a larger constant radius R2, as illustrated by teeth 46 and 47, the tooth contour becomes relatively large while the space 45 between adjacent teeth becomes relatively small. However, the engagement angle a2 of the tooth surface on the forward portion of the tooth 46 becomes positive and larger than a1 thereby enhancing the radial feed of the fluid into the pump passageways.

The asymmetric gear teeth according to the present invention are illustrated in FIGS. 10 and 11 wherein the convex curvature of the forward portion of each tooth has a radius R2 and the convex curvature of the rear portion of each tooth has a radius of curvature R1 wherein R2>R1. Thereby a sufficient space between the adjacent teeth to form the passageways 30 is presented to assure an appropriate cross-sectional area for the radial fluid feed. This tooth profile also provides a tooth engagement angle a of between 20° and 30° allowing the fluid flow filling path to slant with respect to a radius of the outer ring gear, thereby lowering the effects of centrifugal force acting against the fluid entering the pumping cavities. In all instances, corresponding tooth profiles are implemented on the outer teeth of the inner pinion and the internal teeth of the outer ring gear such that their respective profiles are conjugate and whereby contact between the respective teeth is maintained over their entire surface during the motion of the elements.

As a result of this design, the conditions of optimal radial feed are assured and, given a constant pump size, these conditions are improved over the axial feed types of the known prior art. The advantages obtained by this design minimize the dead volume and the centripetal path, as well as the mass of fluid subjected to centrifugal forces due to the reduction of the outside diameter of the ring gear for the purpose of forming the radial passageways between the internal teeth of the ring gear. In a complementary manner, by using the asymmetrical tooth profile, the passageway cross-section of the radial feed can be maximized while preserving an advantageous tooth engagement angle, thereby also minimizing the effects of centrifugal force on the fluid flow into the gear rotor.

The foregoing description is provided for illustrative purposes only and should not be construed as in any way limiting this invention, the scope of which is defined solely by the appended claims.

I claim:

1. A rotary displacement pump having a rotatable gear rotor gear set comprising:

a) an outer ring gear having a plurality of internal teeth whereby an outer diameter D1 of at least a portion of the outer ring gear is approximately equal to a diameter of the root circle of the internal teeth such that the plurality of teeth are circumferentially spaced apart to form generally radial passageways therebetween and at least one annular portion connecting the plurality of teeth;

b) each of the plurality of internal teeth having a forward portion and a rear portion, the forward potion facing in the direction of rotation of the outer ring gear and the rear portion facing away from the direction of rotation, each tooth having a tooth profile comprising a convex forward portion beginning at the outer diameter D1 and continuing to a predetermined end point with a constant radius R1 and a convex rear potion beginning at the predetermined end point of the forward portion and extending to the outer diameter D1 with a constant radius R2 such that R1>R2; and, c) a pinion gear having a plurality of external teeth in engagement with the internal teeth of the ring gear.

2. The rotary displacement pump of claim 1 wherein the at least one annular portion has an outer diameter D2 such that D2>D1.

3. The rotary displacement pump of claim 1 wherein the outer ring gear further comprises a single annular portion connecting the plurality of internal teeth which all extend from the single annular portion in cantilever fashion.

* * * * *